United States Patent [19]

Alexeev et al.

[11] 4,037,576

[45] July 26, 1977

[54] IGNITION SYSTEM FOR INTERNAL-COMBUSTION ENGINES NEGATIVE BIAS TRIGGER

[76] Inventors: Alexandr Nikolaevich Alexeev, Saratovskaya ulitsa, 18/10, kv. 269, Moscow; Igor Ivanovich Zhmurin, shosse Entuziastov, 7a, kv. 6, Balashikha Moskovskoi oblasti; Alexandr Antonovich Moskovsky, Scherbakovskaya ulitsa, 58a, kv. 222, Moscow; Igor Minovich Oparin, ulitsa 9 Rota, 17, kv. 27, Moscow; Vyacheslav Ivanovich Cheplanov, 11 Parkovaya ulitsa, 48, korpus 2, kv. 46, Moscow; Leonid Shlemovich Sokolin, ulitsa Konstantinova, 32, korpus 2, kv. 3, Moscow, all of U.S.S.R.; Vladimir Semenovich Zolotarevsky, deceased, late of Moscow, U.S.S.R.; by Alla Meerovna Zolotarevskaya; Maiya Vladimirovna Zolotarevskaya, administrators, both of Pulkovskaya ulitsa, 11, korpus 1, kv. 33, Moscow, U.S.S.R.

[21] Appl. No.: 602,025

[22] Filed: Aug. 5, 1975

[51] Int. Cl.[2] ..... F02P 1/00

[52] U.S. Cl. ..... 123/148 R; 123/148 DC; 123/148 E

[58] Field of Search ..... 123/148 R, 148 DC, 148 AC, 123/148 E, 148 CC, 148 CB

[56] References Cited

U.S. PATENT DOCUMENTS

| | | | |
|---|---|---|---|
| 3,213,840 | 10/1965 | Confeild | 123/148 CC |
| 3,587,550 | 6/1971 | Zechlin | 123/148 CC |
| 3,729,647 | 4/1973 | Mainprige | 123/148 CC |
| 3,741,185 | 6/1973 | Swift et al. | 123/148 CC |
| 3,874,349 | 4/1975 | Fitzner | 123/148 E |
| 3,880,132 | 4/1975 | Whatley | 123/148 R |
| 3,933,140 | 1/1976 | Gynn | 123/148 CC |
| 3,943,905 | 3/1976 | Hartig | 123/148 CC |

*Primary Examiner*—Ronald H. Lazarus
*Assistant Examiner*—Paul Devinsky

[57] ABSTRACT

An internal-combustion engine ignition system comprises a power source with a voltage stabilizer; a compacitor connected to the power source through a rectifier; several circuits connected in parallel with the capacitor and ignition coil primary windings and thyristors. To the control gate of each of the thyristors is connected a control circuit with a control pulse generator. Also connected to the thyristor control gates is an arrangement for applying a negative bias to the control gates. This arrangement is in the form of a diode whose anode is connected to the cathode of each of the thyristors, whereas the cathode of said diode is connected to the capacitor and is also connected through isolation diodes to the control gate of each of the thyristors.

1 Claim, 2 Drawing Figures

IGNITION SYSTEM FOR INTERNAL-COMBUSTION ENGINES NEGATIVE BIAS TRIGGER

FIELD OF THE INVENTION

The present invention relates to ignition systems for internal-combustion engines and can be used on engines equipped with one or two ignition coils per cylinder, for example, statinary gas engines, racing car engines, rotor-piston engines, etc.

BACKGROUND OF THE INVENTION

It is known in the prior art to effect ignition in internal combustion engines by means of high- and low-tension magnetos or conventional battery ignition systems. Such ignition equipment employs contacts which conduct heavy current and, therefore, lacks operating reliability and needs much attention in service.

To eliminate these disadvantages, solid-state ignition systems have been devised which generate the necessary spark-producing energy, distribute it between the ignition coils of the appropriate cylinders and time the ignition without the use of such contacts.

As an example, reference can be made to the ignition system diagrammatized in the American magazine "Diesel and Gas Turbine Progress," 1968, No. 4, page 4.

This prior art ignition system comprises a power source in the form of an alternator having two separate output windings. One of these windings is connected to a capacitor through a full-wave rectifier in series with a voltage stabilizer. Connected to the capacitor upper plate is the anode of a thyristor whose cathode is connected to the primary winding of the ignition coil.

Pulse shaping is effected by provision of a pulse transformer whose secondary winding is connected to the junction between the thyristor control gate and cathode. One end of the primary winding is connected to a capacitor charged through a voltage divider, the other end of the primary winding is connected to the anode of the control thyristor whose gate is connected to the winding of a control pulse generator.

The quantity of thyristors and pulse shapers corresponds with the number of the cylinders in the engine. While one of the thyristors is operating, the others are standing by. Under these conditions voltage may be induced in the pulse shaper system, causing inadvertant operation of the thyristors. To prevent the thyristors from inadvertant operation, a negative bias supplied from the other winding of the alternator is fed to the thyristor gates.

This prior art ignition system suffers from the disadvantage that it has to employ a complicated arrangement for supplying a negative bias to the thyristor gates and that the sensitivity of the pulse forming system is adversely affected.

OBJECT OF THE INVENTION

It is an object of the present invention to eliminate inadvertant operation of the thyristors in the solid-state ignition system for internal-combustion engines.

SUMMARY OF THE INVENTION

This object is achieved in an ignition system comprising a power source, a voltage stabilizer, a rectifier and a capacitor connected in parallel with circuits composed of series-connected primary windings of ignition coils and thyristors whose gates are connected to a control circuit including a control pulse generator. According to the invention, there is provided an arrangement for applying a negative bias to the thyristor gates, which arrangement is essentially a diode whose anode is connected to the cathode of each of the thyristors, whereas the cathode of the diode is connected to the capacitor and is also connected through isolation diodes to the gate of each of the thyristors.

DESCRIPTION OF THE FIGURES

Now the invention will be described in detail with reference to the accompanying drawings in which.

DISCUSSION OF THE PREFERRED EMBODIMENT

Figure 1:
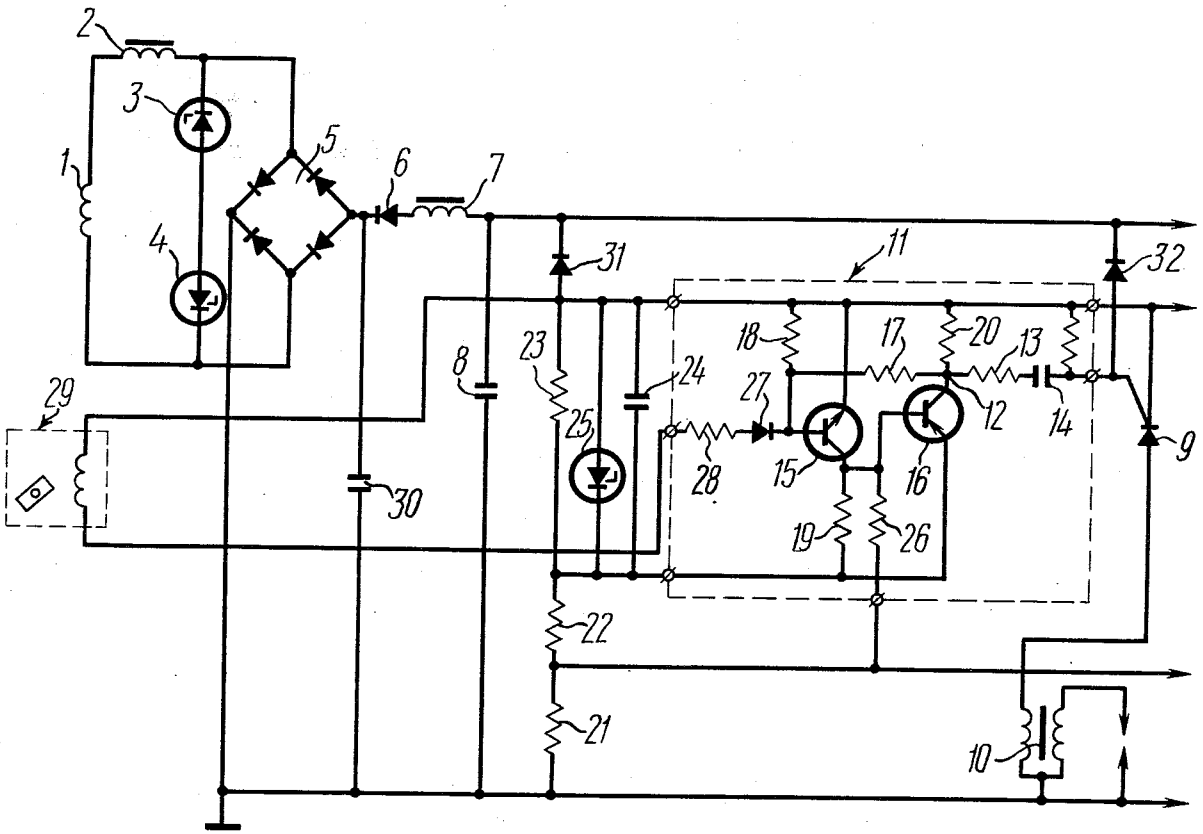
FIG. 1 is a circuit diagram of the internal-combustion engine ignition system arrangement for one cylinder.

Referring to FIG. 1, the ignition system which constitutes the present invention comprises an alternator (not shown) whose output winding 1 is connected through a choke 2 to a voltage stabilizer composed of two differentially connected zener diodes 3 and 4. The voltage stabilizer is connected through a full-wave rectifier 5, a diode 6 and a choke 7 to one of the plates of a capacitor 8. This plate of the capacitor 8 is also connected through diode 31 to the cathode of a thyristor 9, whose anode is connected to a first side of the primary winding of an ignition coil 10. The other plate of capacitor 8 is connected to ground, as is the second side of coil 10. Included in the ignition system is a pulse shaper circuit 11 whose output 12 is connected through a resistor 13 and a capacitor 14 to the control gate of the thyristor 9. The pulse shaper circuit 11 is essentially a two-stage amplifier composed of transistors 15 and 16 of different conducting direction and including a resistor 17 to effect positive feedback. A resistor 18 forms a bias resistance for the input transistor 15. Resistors 19 and 20 load the transistors 15 and 16 respectively. The pulse shaper circuit 11 is fed from a voltage divider composed of resistors 21, 22 and 23. A capacitor 24 and a zener diode 25 are connected in parallel with the resistor 23. The resistor 22 in the voltage divider supplies cutoff bias through a limiting resistor 26 to the base of the output transistor 16.

The base of the input transistor 15 is connected to the winding of a magnetoelectric control pulse generator 29 through a diode 27 and a resistor 28 which limits the base current of the transistor 15.

The quantity of the ignition coils 10, thyristors 9, pulse shaper circuits 11 and windings of the control pulse generator 29 corresponds with the number of the cylinders in the engine.

Figure 2:
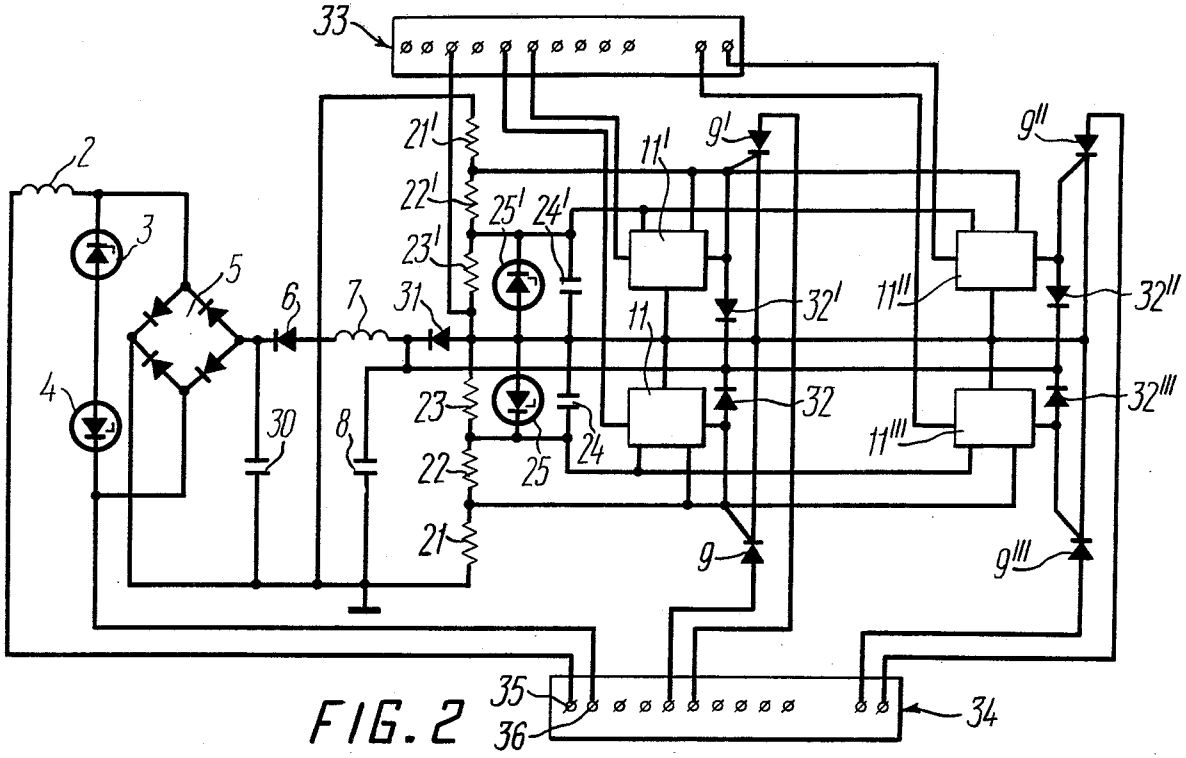
FIG. 2 shows the ignition system arrangement for severl cylinders.

Referring to FIG. 2, the cathodes of all the thyristors 9, 9', 9'', 9''' are connected to the capacitor 8. The pulse shaper circuit 11 is the same as in FIG. 1. There are two voltage dividers which feed two groups of pulse shaper circuits 11 in order to adapt the ignition system for use on engines with nonuniform sparking. For the same purpose provision is also made of a capacitor 30 connected to the output of the rectifier 5.

To apply a negative bias to the control gates of the thyristors 9, a diode 31 is connected between the junction of the thyristor cathodes and the capacitor 8. The junction between the cathode of the diode 31 and the capacitor 8 is connected to the control gates of the thyristors 9 through isolation diodes 32.

The windings of the pulse generator 29, alternator 1 and ignition coils are not shown in FIG. 2. The ends of these windings are connected to the terminals of connectors 33 and 34. The output winding of the alternator 1 is connected to the terminals 35 and 36 of the connector 34. The primary windings of the ignition coils are connected to the other terminals of the connector 34. The windings of the control pulse generator are connected to the terminals of the connector 33.

The ignition system which constitutes the present invention operates as follows:

The alternating voltage output from the alternator winding 1 feeds into the rectifier 5. The zener diodes 3 and 4 and the choke 2 incorporated in the voltage stabilizer limit the voltage output either way. The rectified voltage charges the capacitors 30 and 8. At the same time rotating electromotive force is set up in the winding of the control pulse generator 29 and the latter sends pulses to the base of the input transistor 15 incorporated in the pulse shaper circuit 11. Since the conducting direction of the transistors 15 and 16 is opposite, they are closed as long as there is no pulse from the pulse generator 29, the pulse shaper circuit 11 practically consuming no power under these conditions.

When a pulse from the pulse generator 29 comes to the base of the transistor 15, the transistors 15 and 16 open and the capacitor 24 discharges through the transistor 16 to the control gate of the thyristor 9.

The thyristor 9 switches on and the capacitor 8 is recharged through the diode 31 and the primary winding of the ignition coil 10.

When the capacitor 8 is recharged to the reverse polarity, part of the power is supplied to the secondary winding of the ignition coil 10 and is converted into the energy of spark discharge.

The thyristor 9 switches off and further recharge of the capacitor 8 to the initial polaritity takes place through the circuit composed by the choke 7, diode 6 and the diodes of the rectifier 5.

At the same time the capacitor 8 receives additional charge from the capacitor 30. The diodes 6 prevents the capacitor 8 from discharging to the capacitor 30 when the voltage across the capacitor 8 is higher than that across the capacitor 30.

The capacitor 30 provides for charging the capacitor 8 even if the latter has not got charge from the rectifier 5 before the thyristor 9 is tripped, for example, in the event of non-uniform spark intervals.

When one of the thyristors, for example the thyristor 9, switches, a negative bias from the diode 31 is applied to the control gates of the other thyristors 9', 9'' and 9''' through the isolation diodes 32, 32', 32'' and 32''', whereby the thyristors 9', 9'' and 9''' are prevented from accidentally coming into action while there is no control pulse.

The voltage drop across the diode 31 is greater than the voltage induced by the operation of one of the thyristors. This voltage drop applies a negative bias to the thyristor control gates, securely preventing the thyristors from inadvertant operation.

What is claimed is:

1. An internal-combustion engine ignition system comprising: a power source with a voltage stabilizer; a capacitor connected through a rectifier to said power source; electric circuits connected in parallel with said capacitor, each circuit including an ignition coil in series with a thyristor, to the control gate of which is connected a pulse shaper circuit with a control pulse generator; an arrangement for applying a negative bias to the control gates of said thyristors, which arrangement comprises a diode whose anode is connected to the cathode of each of said thyristors, whereas the cathode of said diode is connected to said capacitor and is also connected through isolation diodes to the control gate of each of said thyristors.

* * * * *